US008851282B2

(12) United States Patent
Brunner

(10) Patent No.: US 8,851,282 B2
(45) Date of Patent: Oct. 7, 2014

(54) MOBILE TOOL BOX

(75) Inventor: Yaron Brunner, Timrat (IL)

(73) Assignee: Keter Plastic Ltd., Herzelyia (IL)

( * ) Notice: Subject to any disclaimer, the term of this patent is extended or adjusted under 35 U.S.C. 154(b) by 0 days.

(21) Appl. No.: 13/522,400

(22) PCT Filed: Jan. 19, 2011

(86) PCT No.: PCT/IL2011/000059

§ 371 (c)(1),
(2), (4) Date: Jul. 16, 2012

(87) PCT Pub. No.: WO2011/089598

PCT Pub. Date: Jul. 28, 2011

(65) Prior Publication Data

US 2012/0292213 A1 Nov. 22, 2012

Related U.S. Application Data

(60) Provisional application No. 61/296,083, filed on Jan. 19, 2010.

(51) Int. Cl.
*B65D 85/00* (2006.01)
*B65D 43/20* (2006.01)
*B25H 3/02* (2006.01)

(52) U.S. Cl.
CPC ..... *B25H 3/028* (2013.01)
USPC ..... 206/372; 220/345.5; 220/345.2; 206/373

(58) Field of Classification Search
USPC ..... 220/345.5, 812, 592.03, 345.2, 345.1; 206/372, 373, 349
See application file for complete search history.

(56) References Cited

U.S. PATENT DOCUMENTS

| | | | | | |
|---|---|---|---|---|---|
| 698,558 | A | * | 4/1902 | Rosenbaum | 190/111 |
| 1,421,645 | A | * | 7/1922 | Wilson | 220/521 |
| 1,597,092 | A | * | 8/1926 | McTighe | 220/812 |
| 1,702,621 | A | | 2/1929 | Stelljes | |

(Continued)

FOREIGN PATENT DOCUMENTS

| | | | |
|---|---|---|---|
| DE | 202004020112 | U1 | 2/2005 |
| GB | 2445216 | A | 7/2008 |
| JP | 09110061 | | 4/1997 |
| WO | 2008090546 | A1 | 7/2008 |

OTHER PUBLICATIONS

PCT/IL2011/000059, International Search Report, Mailed Jul. 22, 2011.

(Continued)

*Primary Examiner* — Anthony Stashick
*Assistant Examiner* — Mollie Llewellyn
(74) *Attorney, Agent, or Firm* — Wiggin And Dana LLP; Gregory S. Rosenblatt; Jonathan D. Hall

(57) ABSTRACT

A transportable tool box comprising a large compartment configured with upright extending side walls defining a top opening of the large compartment configured with a locomotive arrangement, and two compartmented covers slidingly displaceable over the top opening of the large compartment between a closed position wherein the covers coextend and cover the top opening, and an open position wherein the two covers are displaced away from one another and expose the large compartment to allow access thereto. A locking arrangement is provided for arresting the compartmented covers at the closed position.

14 Claims, 18 Drawing Sheets

(56) References Cited

U.S. PATENT DOCUMENTS

| | | | | | |
|---|---|---|---|---|---|
| 3,317,097 | A * | 5/1967 | Giordano | 224/182 |
| 4,502,610 | A * | 3/1985 | Todd | 220/315 |
| 4,600,113 | A * | 7/1986 | DeMars | 220/212 |
| 4,848,588 | A * | 7/1989 | Rasmussen | 206/581 |
| 5,042,683 | A * | 8/1991 | Shaw et al. | 220/345.3 |
| 5,181,619 | A * | 1/1993 | Noble | 209/702 |
| 5,228,706 | A * | 7/1993 | Boville | 280/43.22 |
| 5,386,907 | A * | 2/1995 | Kahl et al. | 206/315.11 |
| 5,730,451 | A * | 3/1998 | Walker | 280/47.26 |
| 5,826,718 | A * | 10/1998 | Ahern et al. | 206/372 |
| D415,658 | S | 10/1999 | Frehse | |
| 6,138,831 | A * | 10/2000 | Agostinelli | 206/541 |
| 6,318,713 | B1 | 11/2001 | Levi | |
| D467,426 | S | 12/2002 | Hardigg et al. | |
| 6,595,381 | B1 * | 7/2003 | Johnson | 220/345.1 |
| 6,935,067 | B1 * | 8/2005 | Richter et al. | 43/4 |
| 7,017,740 | B2 * | 3/2006 | Itzkovitch | 206/372 |
| 7,284,763 | B1 * | 10/2007 | King | 280/47.26 |
| D574,150 | S | 8/2008 | Ross | |
| D609,911 | S | 2/2010 | Twig | |
| D613,560 | S | 4/2010 | Robichaud et al. | |
| 7,708,137 | B1 * | 5/2010 | Rowley et al. | 206/223 |
| D630,851 | S | 1/2011 | Landau et al. | |
| D649,783 | S * | 12/2011 | Brunner | D3/279 |
| D663,952 | S * | 7/2012 | Crevling et al. | D3/274 |
| 2002/0117414 | A1 | 8/2002 | Kipper et al. | |
| 2002/0163284 | A1 | 11/2002 | Levy et al. | |
| 2004/0149766 | A1 * | 8/2004 | Karpisek | 220/812 |
| 2006/0006770 | A1 | 1/2006 | Valentini | |
| 2007/0062953 | A1 * | 3/2007 | Lin | 220/345.5 |
| 2010/0000893 | A1 * | 1/2010 | Twig et al. | 206/373 |

OTHER PUBLICATIONS

PCT/IL2011/000059, International Report on Patentability, Mailed Jul. 24, 2012.

Search Report of the State Intellectual Property Office of the People's Republic of China, CN 2011800058524, Mar. 4, 2014.

* cited by examiner

MOBILE TOOL BOX

CROSS-REFERENCE TO RELATED APPLICATIONS

This application is the National Stage of International Application No. PCT/IL2011/000059, filed Jan. 19, 2011, the entire disclosure of which is incorporated herein by reference.

FIELD OF THE INVENTION

This invention relates to tool box, and more particularly it is concerned with a transportable tool box.

BACKGROUND OF THE INVENTION

Storage containers for tools and tool boxes are well known in the art. It is generally desired for a toolbox to be easily movable for use in various locations. For larger tool boxes the weight of the tool box and tools therein often hinder its mobility. A tool box with locomotive arrangement can solve such a problem. Additionally it is beneficial for the locomotive arrangement to be integrally designed in the tool box for durability and robustness.

The term tool box as used herein the specification and claims is used in its broad sense and refers to any container for storing, locomoting and displaying articles of any kind.

SUMMARY OF THE INVENTION

The disclosed subject matter provides a tool box comprising a large bin accessible through a top opening which is concealable by covers slidable between open and closed positions, each comprising storage space. The tool box is locomoted by wheels and an extractable handle.

According to the present disclosure there is provided a tool box comprising a large compartment configured with upright extending side walls defining a top opening of the large compartment configured with a locomotive arrangement; and two compartmented covers slidingly displaceable over the top edge defining an opening of the large compartment, between a closed position wherein the covers coextend and cover the top opening, and an open position wherein the two covers are displaced away from one another and expose the large compartment to allow access thereto; with a locking arrangement provided for arresting the compartmented covers at the closed position.

The term compartmented cover as used hereinafter in the specification denotes an element serving both as a cover for the large compartment and configured with a storage compartment which may be further divided either fixedly or modularly, i.e. by bins or partition walls or combinations thereof.

Any one or more of the following features and design may be applied in connection with the tool box according to the present disclosed subject matter:

- The compartmented covers are slidably secured to the large compartment by a pair of drawer-type slides, facilitating firm support of the compartmented covers also at the fully open position. Smooth operation thereof is facilitated by the provision of ball bearings.
- The locomotive arrangement comprises at least one pair of wheels fitted near or at a bottom of the large compartment and a manipulating handle articulated with the large compartment;

- The compartmented covers are slidingly retained over the top edge of the large compartment, wherein at the closed position they mate about a center of the large compartment;
- At the open position the compartmented covers are fully displaced from the top opening of the large compartment, to thereby facilitate full access thereto. This is achieved by a rail system fitted at the top front and top rear edges of the large compartment.
- The locking arrangement provided for arresting the compartmented covers at the closed position to prevent their displacement at the closed position, as well as to prevent access to the large compartment. According to a particular design, at the locked state the storage compartment of the covers is locked as well;
- According to a particular design, the locking arrangement is a slam-type lock, i.e. locking engagement of the compartmented covers is achieved by displacing them towards one another until mating, resulting in spontaneous locking arresting of a locking latch provided in one of said compartmented covers arrests with a respective latch provided in an other of said compartmented covers;
- The compartmented covers are provided with lids covering the storage compartments. According to a particular configuration the respective lids are locked when the compartmented covers are at the locked position.
- The locking arrangement is configured for receiving a lock to prevent unauthorized opening of the tool box and access to its compartments;
- The manipulating handle is manipulable between a stowed position and a locomoting position, in which it extends from the tool box to facilitate its locomotion;
- The manipulating handle is slidably displaceable between the stowed (retracted) position in which it substantially blends with the large compartment, and the locomotive (extracted) position in which it facilitates manipulating (pulling/pushing) of the tool box in a cart like position. According to a particular configuration, a pair of wheels are provided at a bottom side edge of the large compartment (articulated to either the base or a bottom portion of the side wall), and the handle is extractable from an opposite top side edge of the large compartment. According to one design, the handle comprises two side arms interconnected by a grip portion, wherein the side arms are slidably retained along respective top front and rear edges of the large compartment, and wherein the grip portion is substantially parallel to the respective top side edge such that at the retracted position it is flush with the large compartment.

BRIEF DESCRIPTION OF THE DRAWINGS

In order to understand the invention and to see how it may be carried out in practice, embodiments will now be described, by way of a non-limiting example only, with reference to the accompanying drawings, in which.

DETAILED DESCRIPTION OF SPECIFIC EMBODIMENT

Figure 1A:
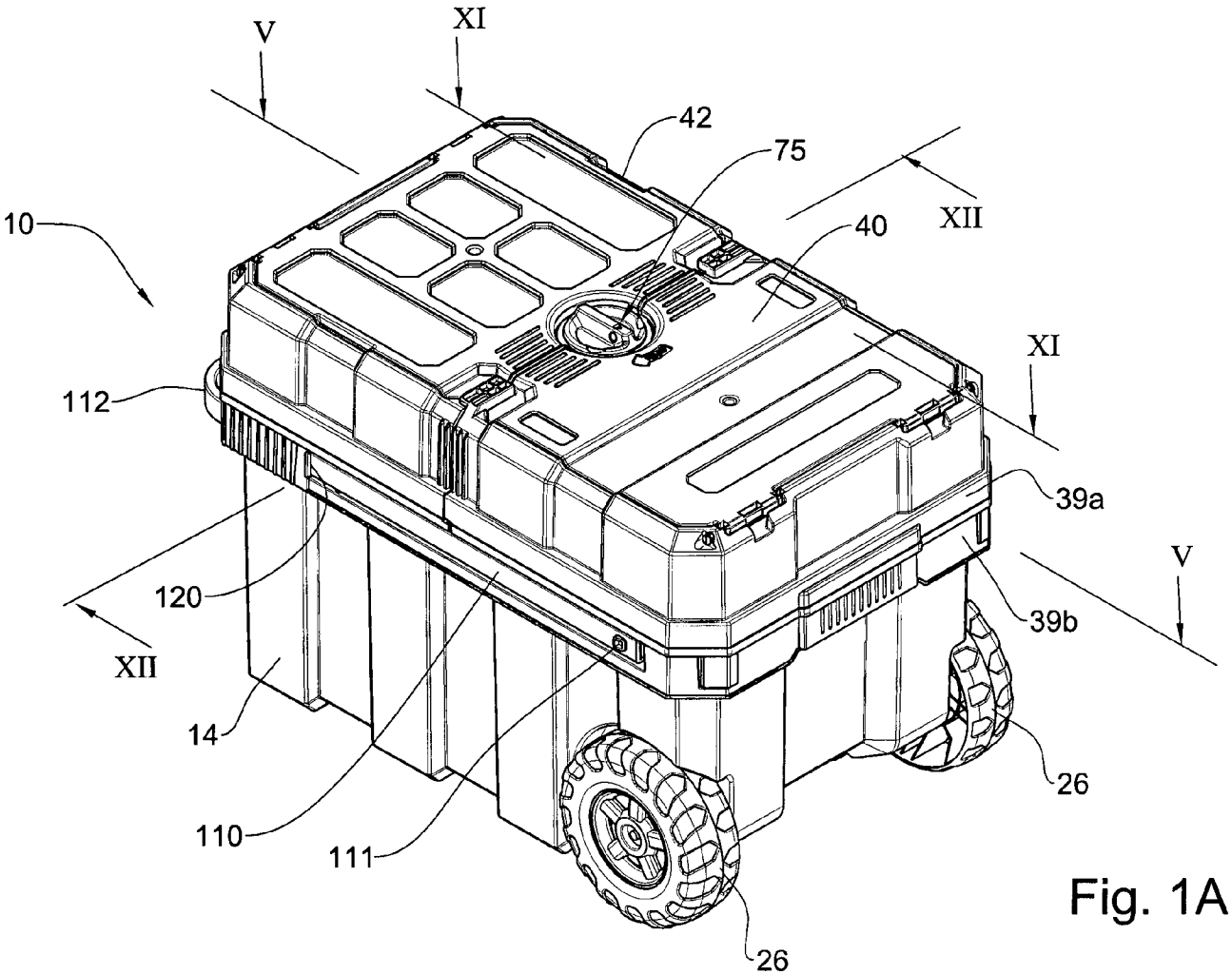
FIG. 1A is a front perspective view of a tool box in accordance with the present disclosed subject matter, the tool box in its closed position.

With reference to the accompanying drawings there is illustrated a transportable tool box generally designated 10 comprising a basin-like large compartment 14 configured with a bottom base 16 from which four substantially upright side walls 18 extend, defining by their top edges 20 a top opening of the large compartment 14.

Figure 1B:
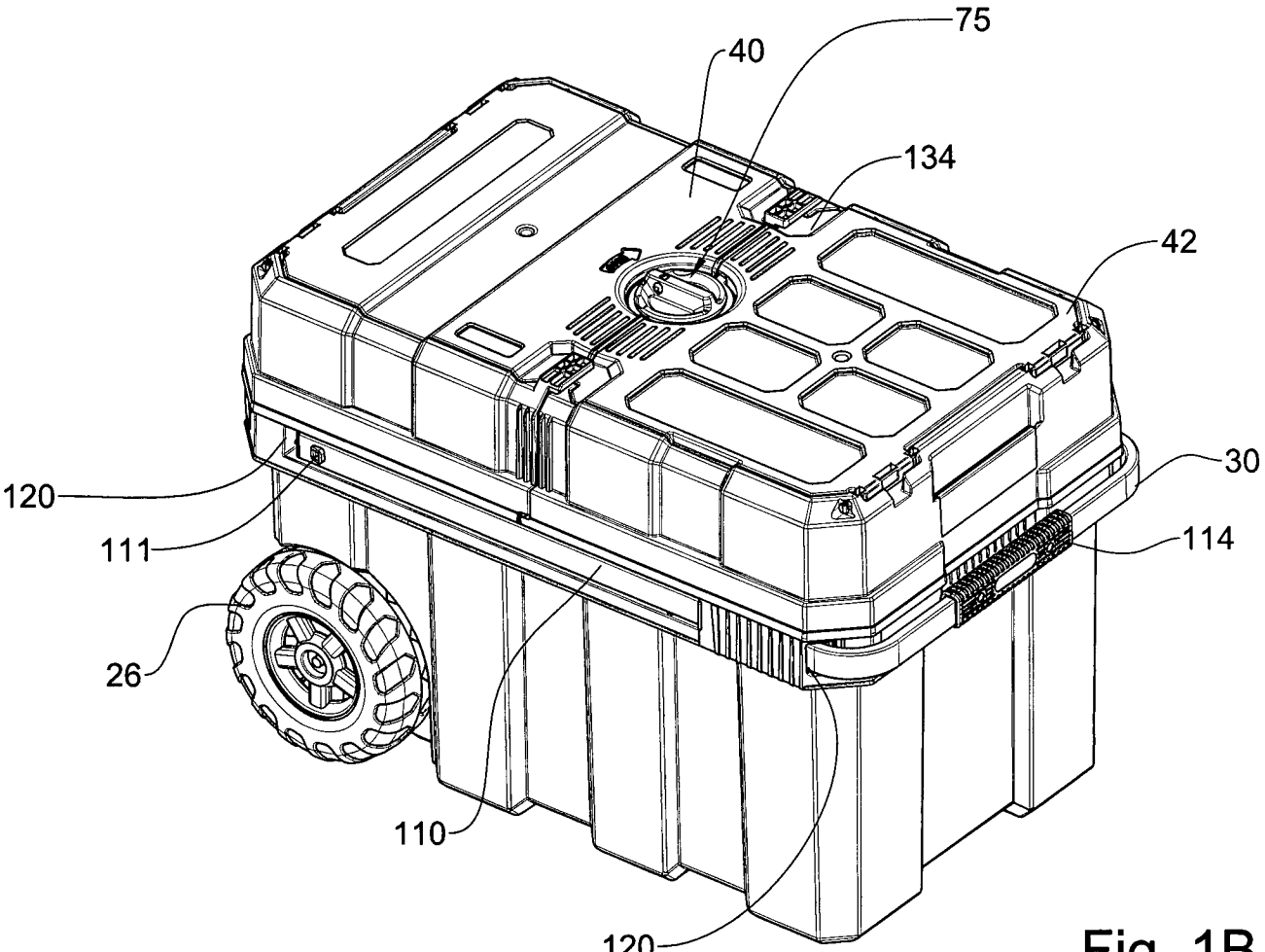
FIG. 1B is a rear perspective view of the tool box of FIG. 1A.

The tool box 10 is fitted with a locomotive arrangement comprising a pair of wheels 26 extending at a bottom, rear end of the large compartment 14 and a manipulating handle 30 displaceable between a fully retracted position (FIGS. 1A and 1B) and a fully extracted position (FIGS. 2A to 4B) facilitating locomoting the tool box 10 by either pulling or pushing thereof over a surface. The substantially large size of wheels 26 facilitates transportation of the tool box also over substantially rough surfaces.

Figure 1C:
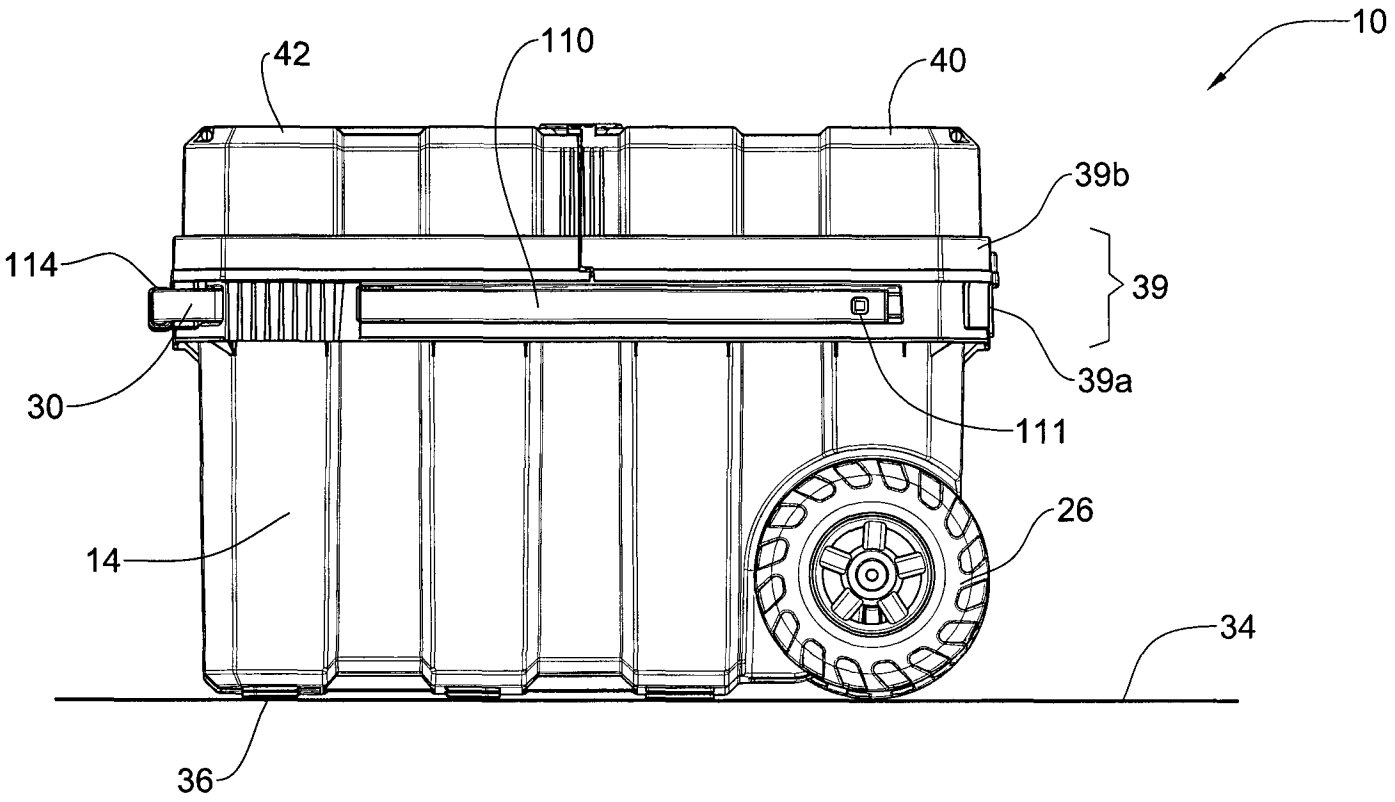
FIG. 1C is a front elevation of the tool box of FIG. 1A.
Figure 1D:
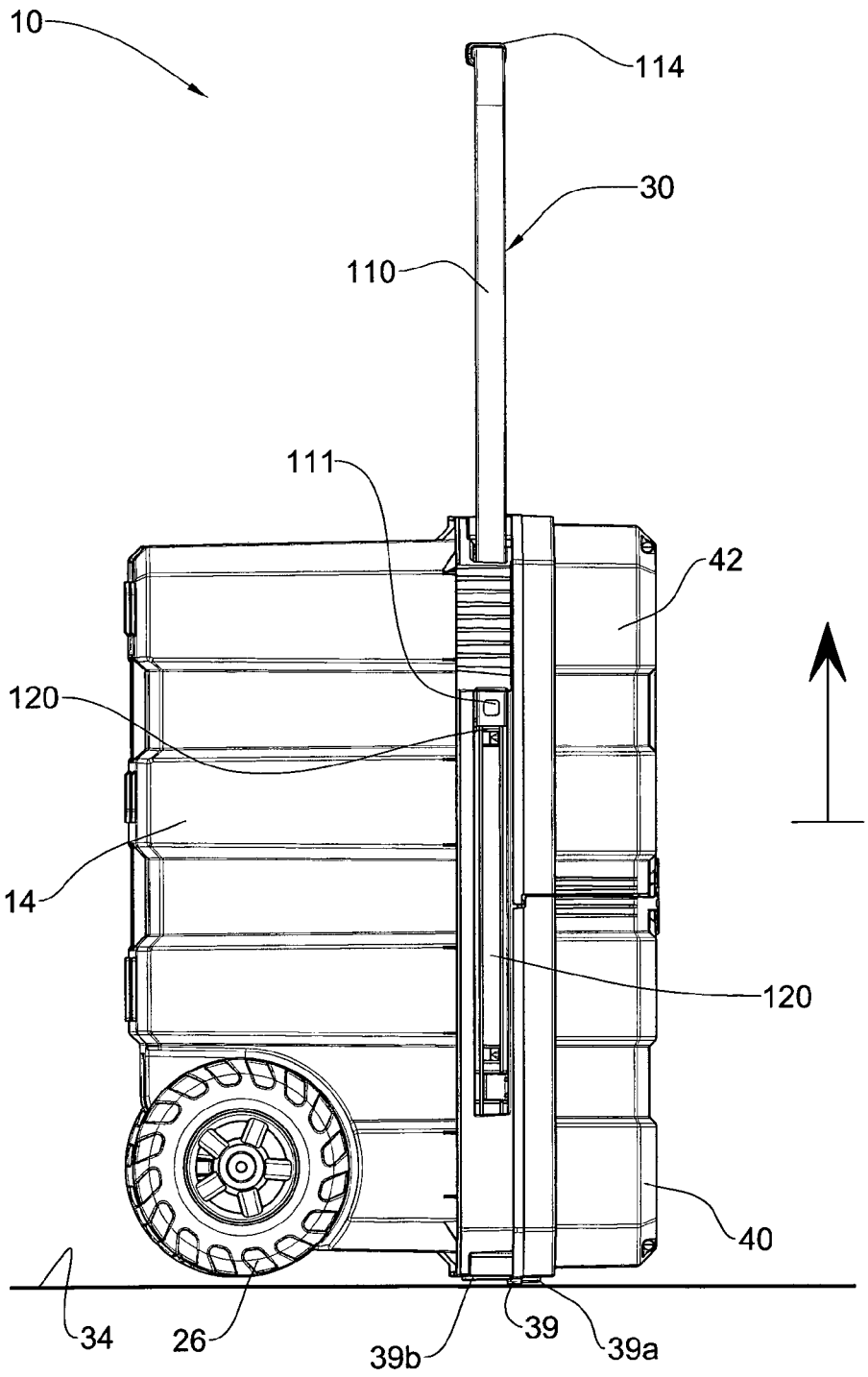
FIG. 1D is a front elevation of a tool box in accordance with the present invention, at an upright position with the manipulating handle extracted.
Figure 2A:
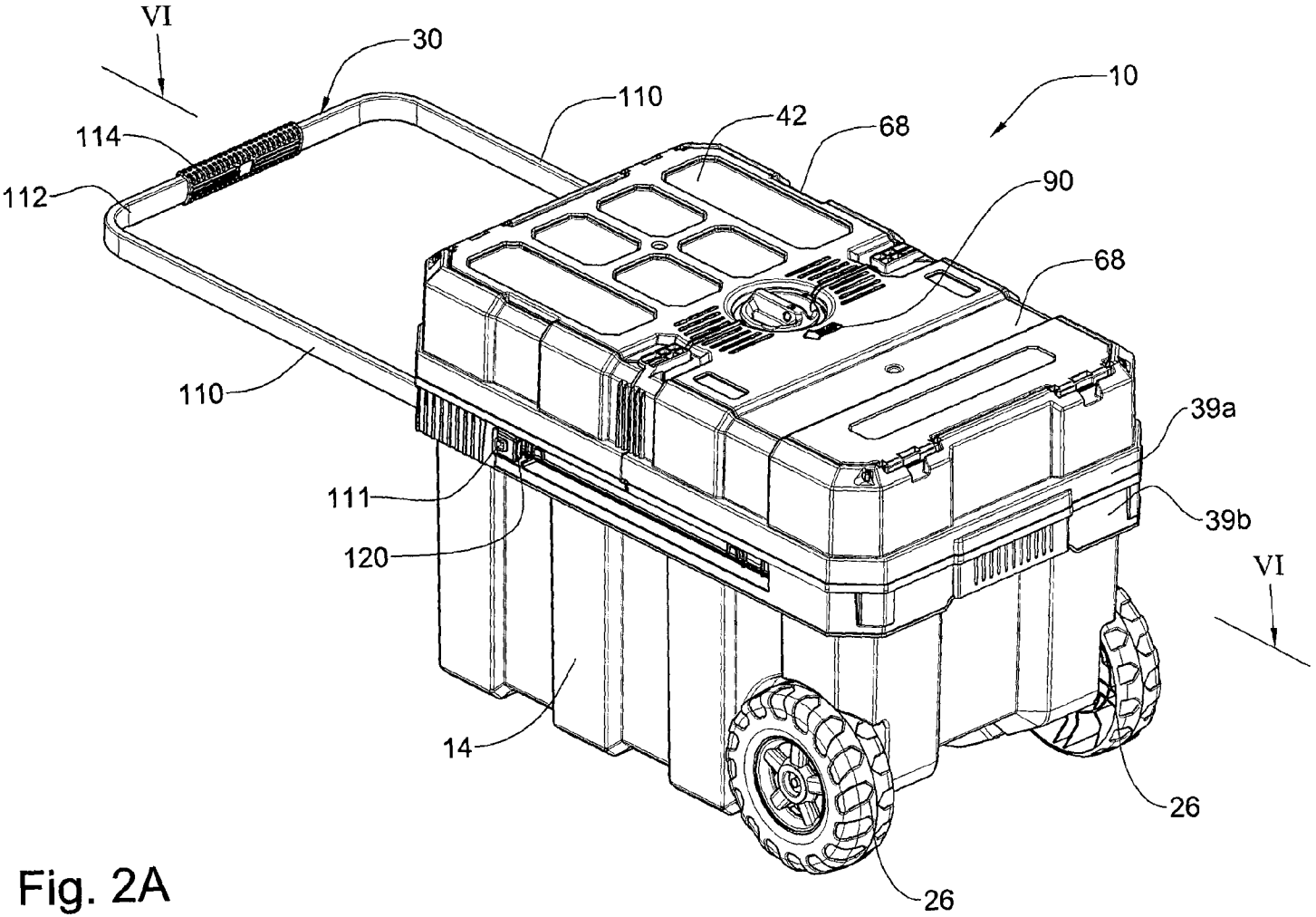
FIG. 2A corresponds with FIG. 1A, with a manipulating handle at its extracted position.
Figure 2B:
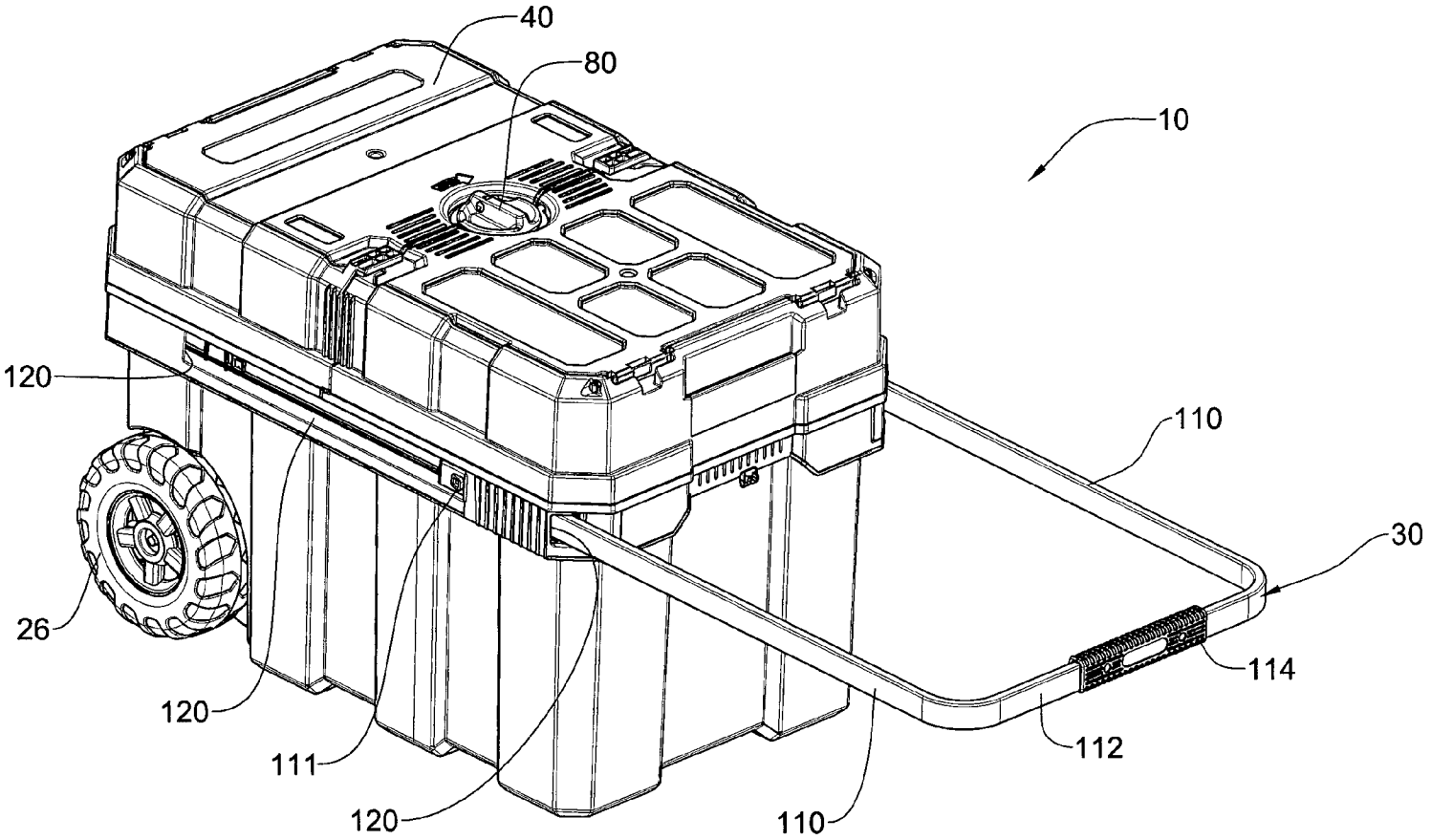
FIG. 2B is a rear perspective view of FIG. 2A.

Further noticed, best in FIG. 1C, the wheels 26 are positioned such that when the tool box 10 rests over a surface 34, bottom surface segments 36 extend on the ground surface 34 and the surface is tangent to the wheels 26. However, upon tilting of the tool box in a clockwise direction (e.g. by aid of manipulating handle 30) the bottom surface 36 of the tool box disengages from the ground with the wheels 26 being free to rotate over the surface 34 for easy locomotion of the tool box 10.

The basin-like large compartment 14 is a rigid structure, typically made of molded plastic material reinforced by a plurality of ribs 19 extending along the side walls and the base 16.

Figure 3:
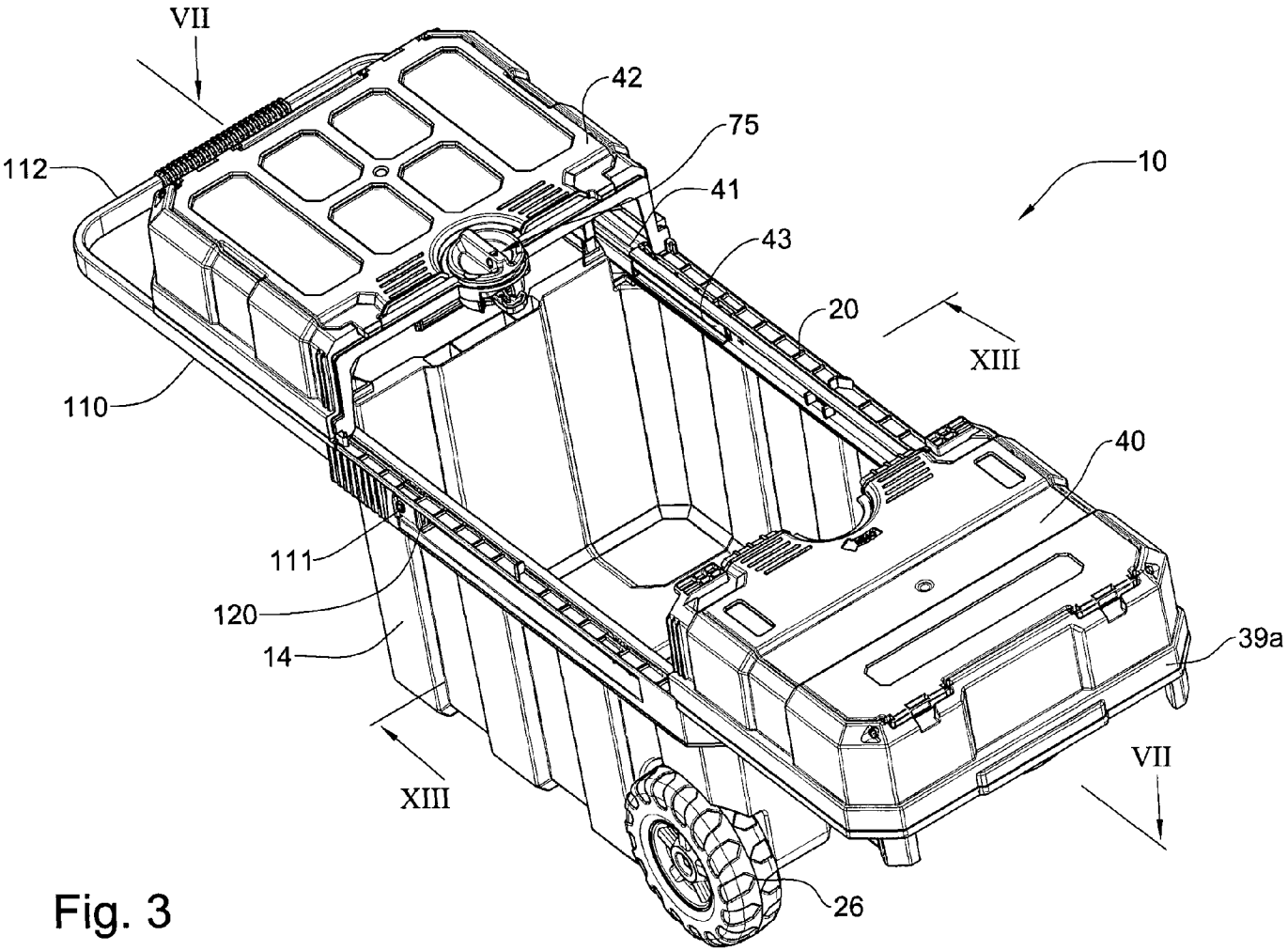
FIG. 3 is a perspective view of the tool box in its open position, allowing full access to the large compartment thereof.
Figure 4A:
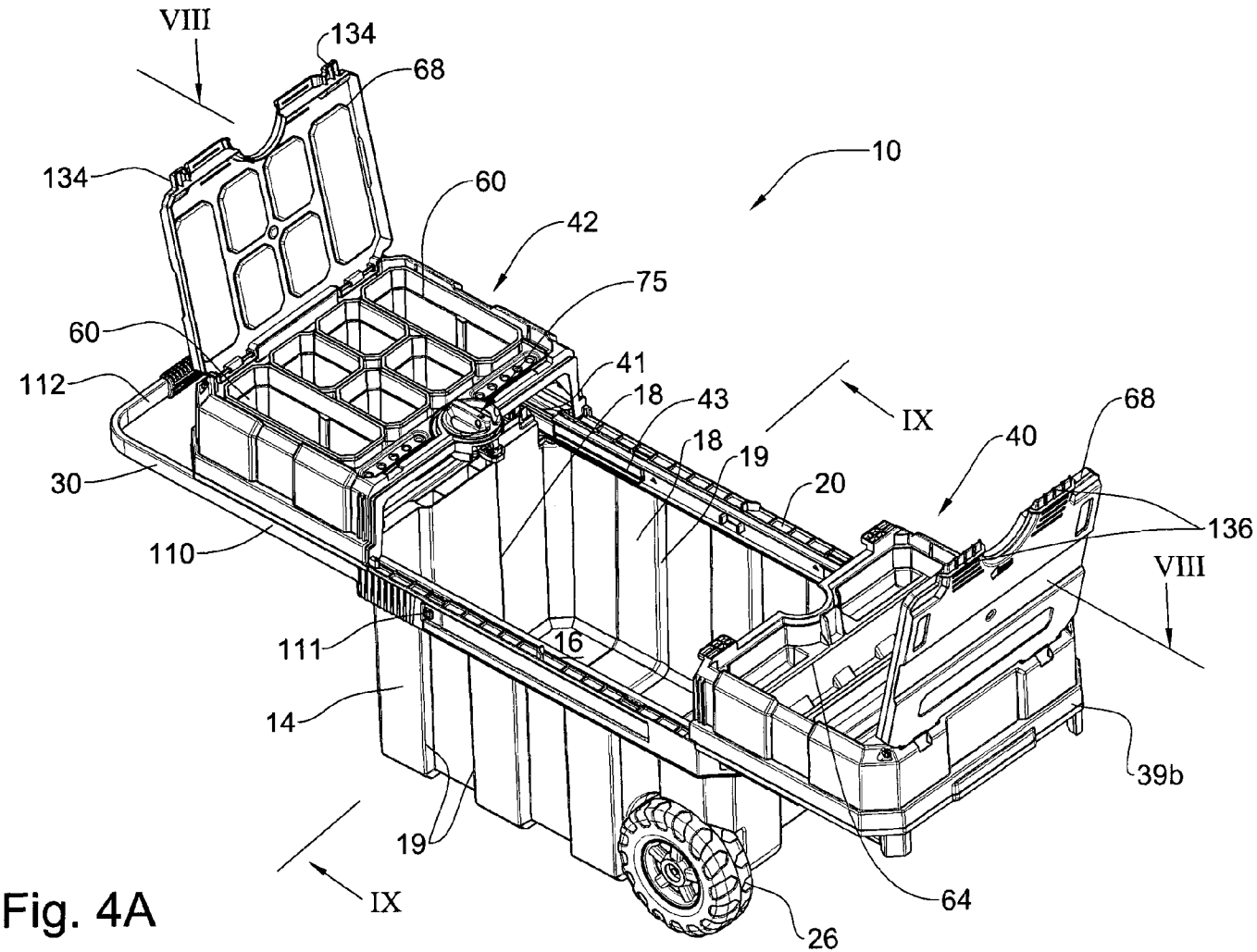
FIG. 4A illustrates the tool box in the position of FIG. 3, however with lids of the compartmented covers at their open position.
Figure 4B:
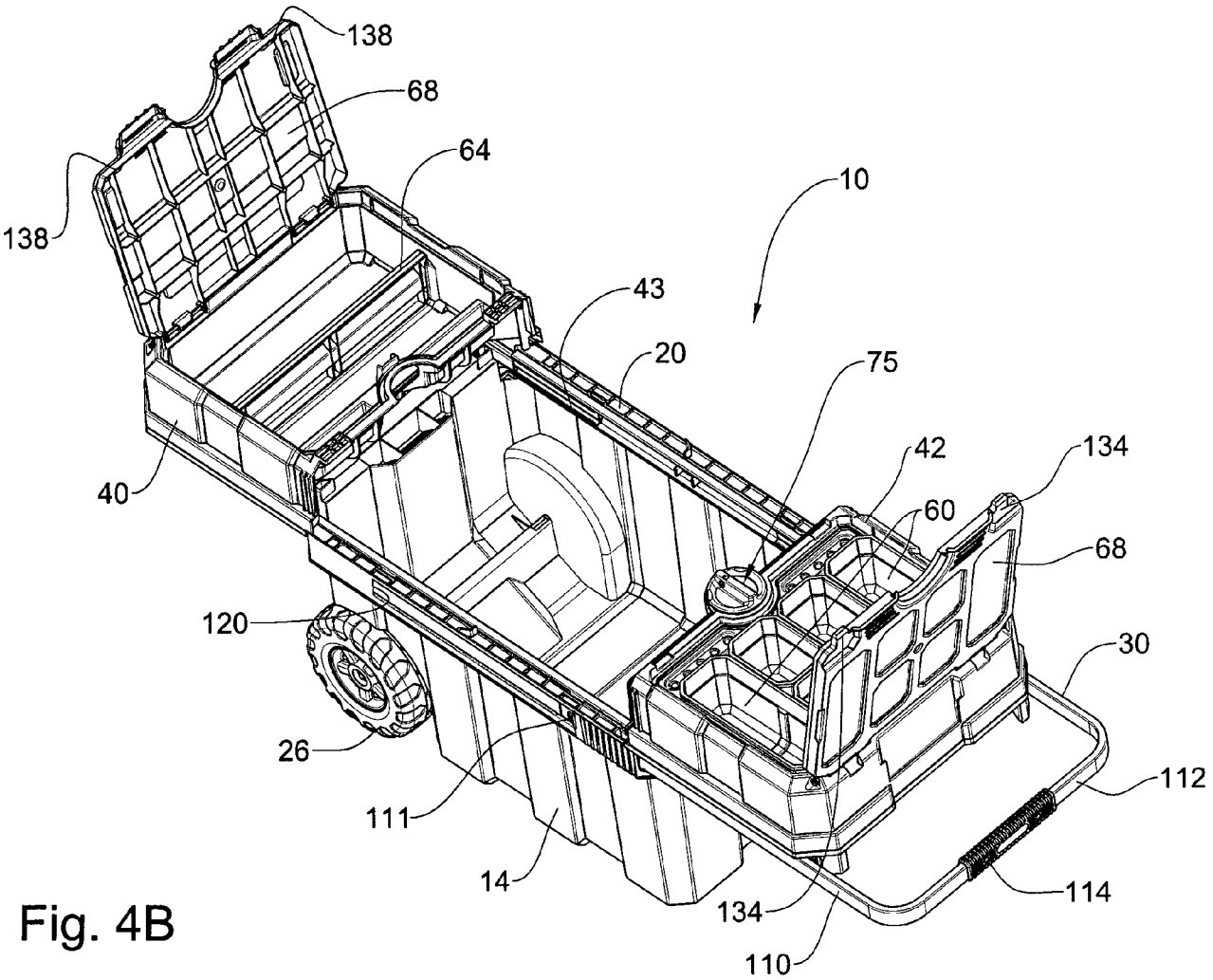
FIG. 4B is a rear isometric view at the position illustrated in FIG. 4A.
Figure 5A:
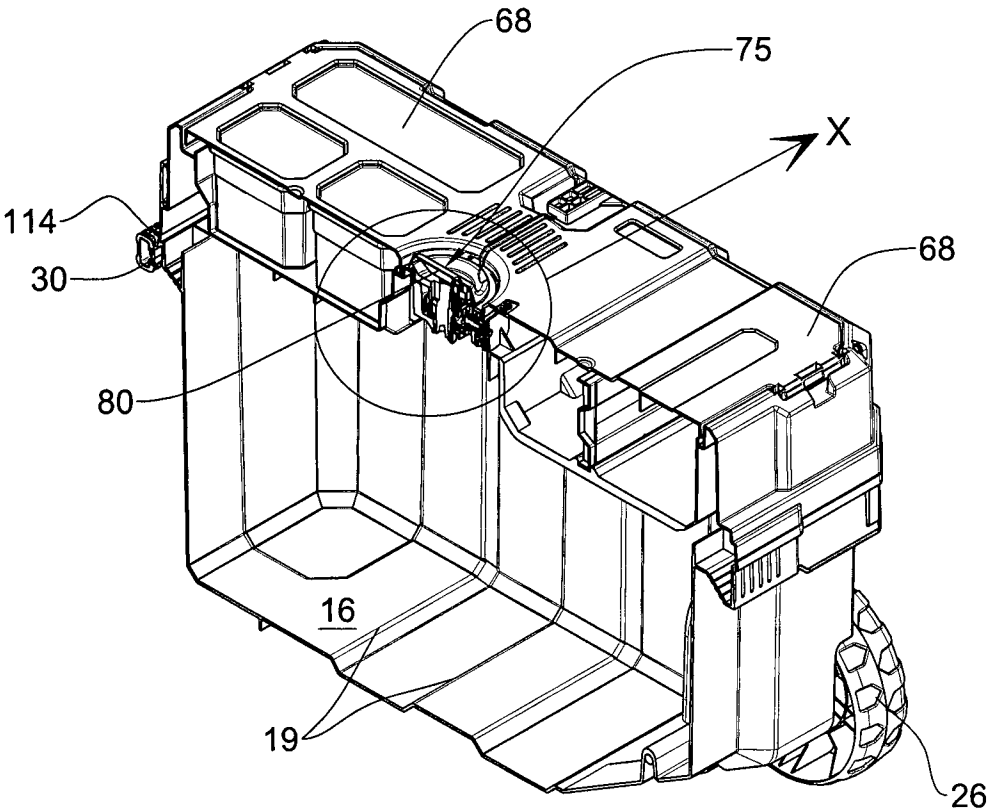
FIG. 5A is a section along line V-V in FIG. 1A.
Figure 5B:
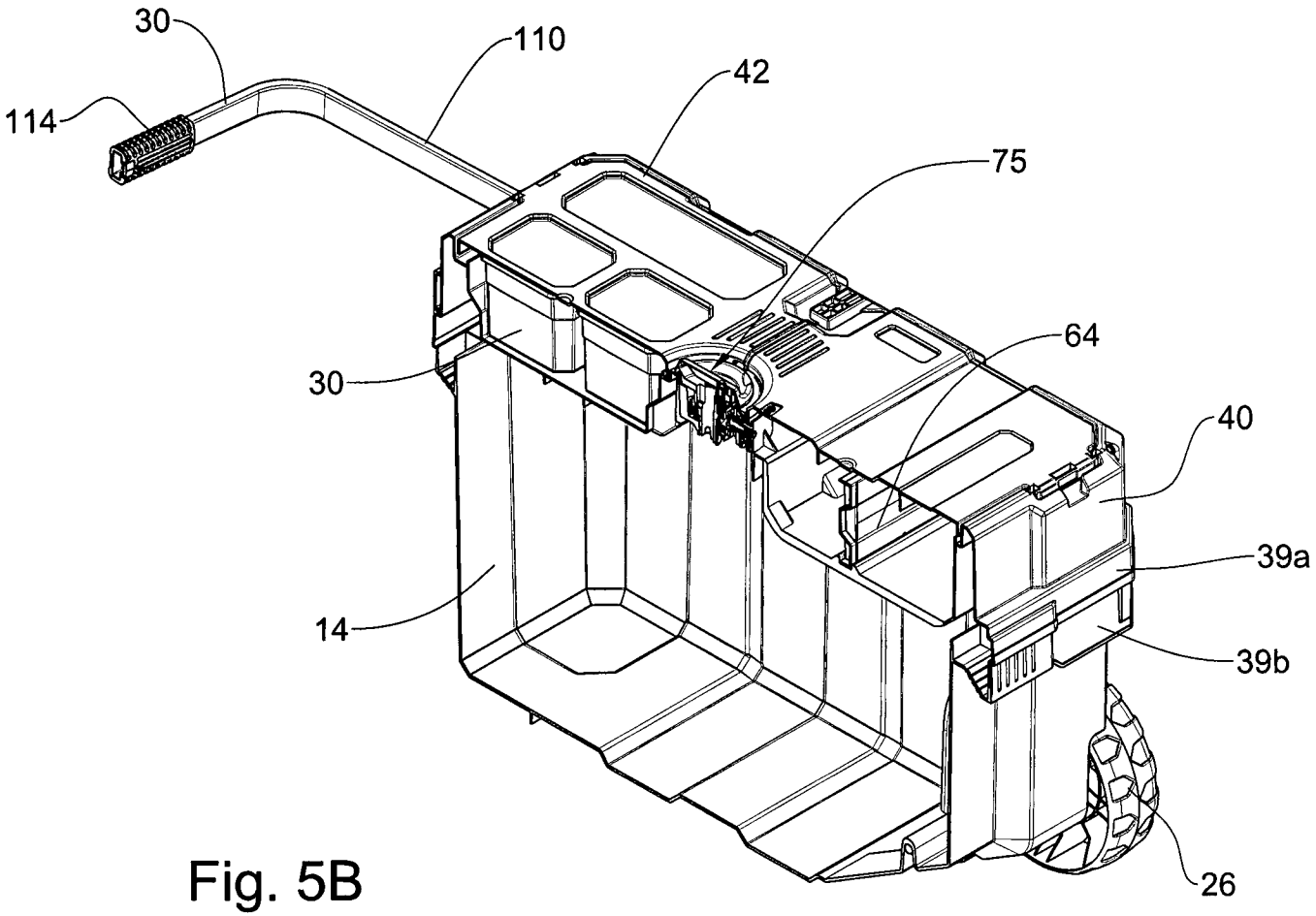
FIG. 5B is a section along line VI-VI in FIG. 2A.
Figure 5C:
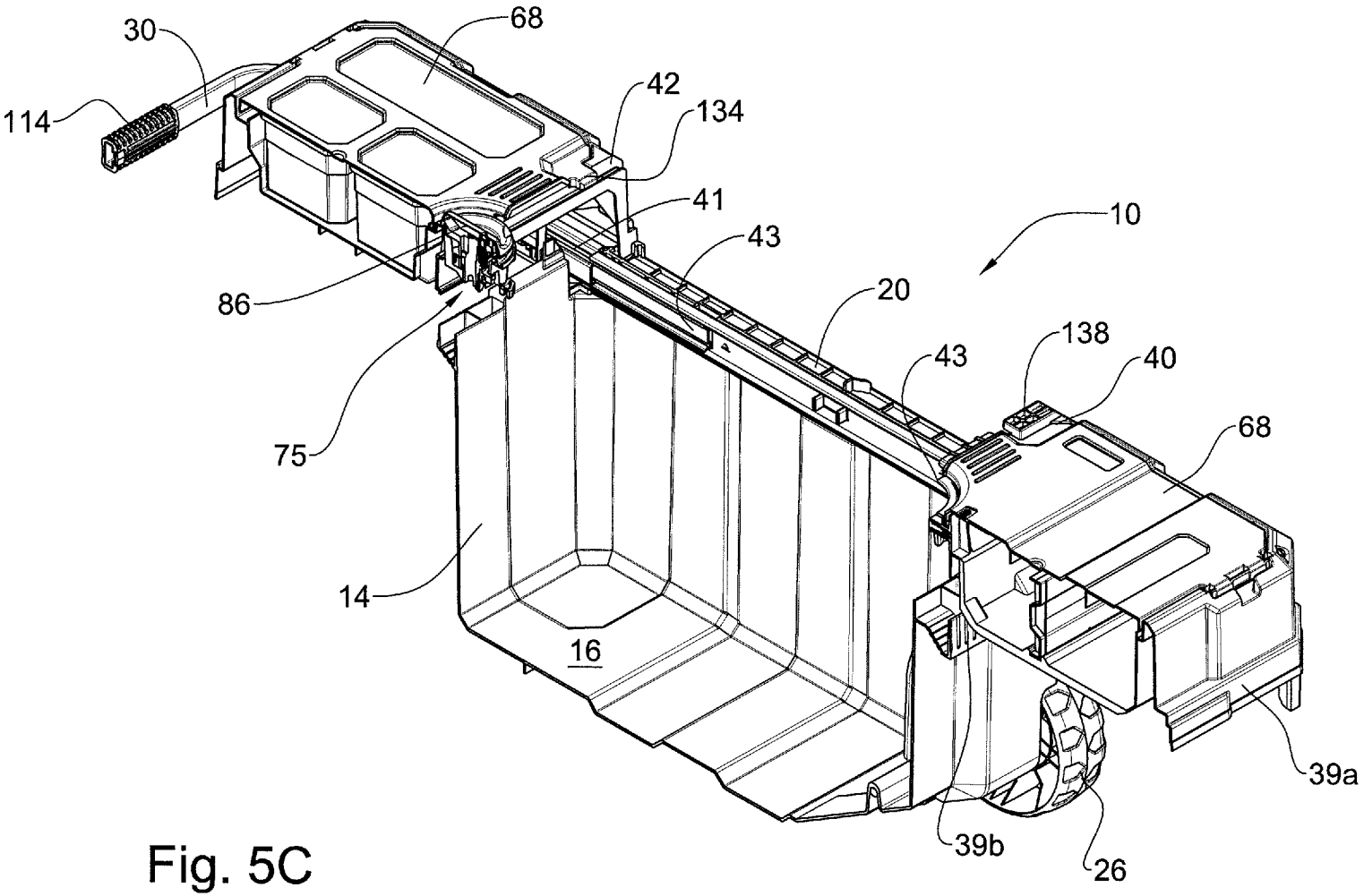
FIG. 5C is a sectioned view along line VH-VII in FIG. 3.
Figure 5D:
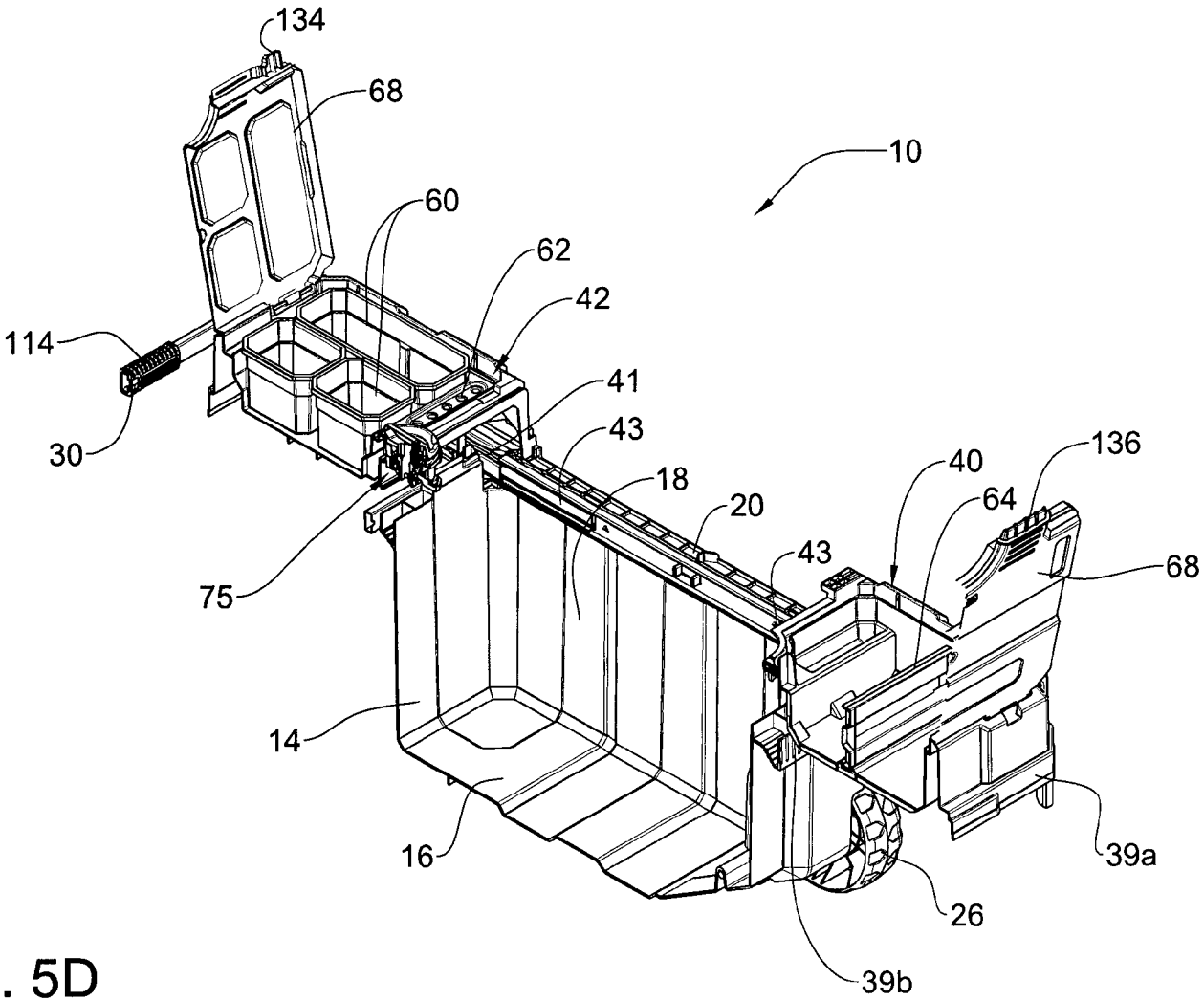
FIG. 5D is a sectioned isometric view along a line VIII-VIII in FIG. 4A.
Figure 5E:
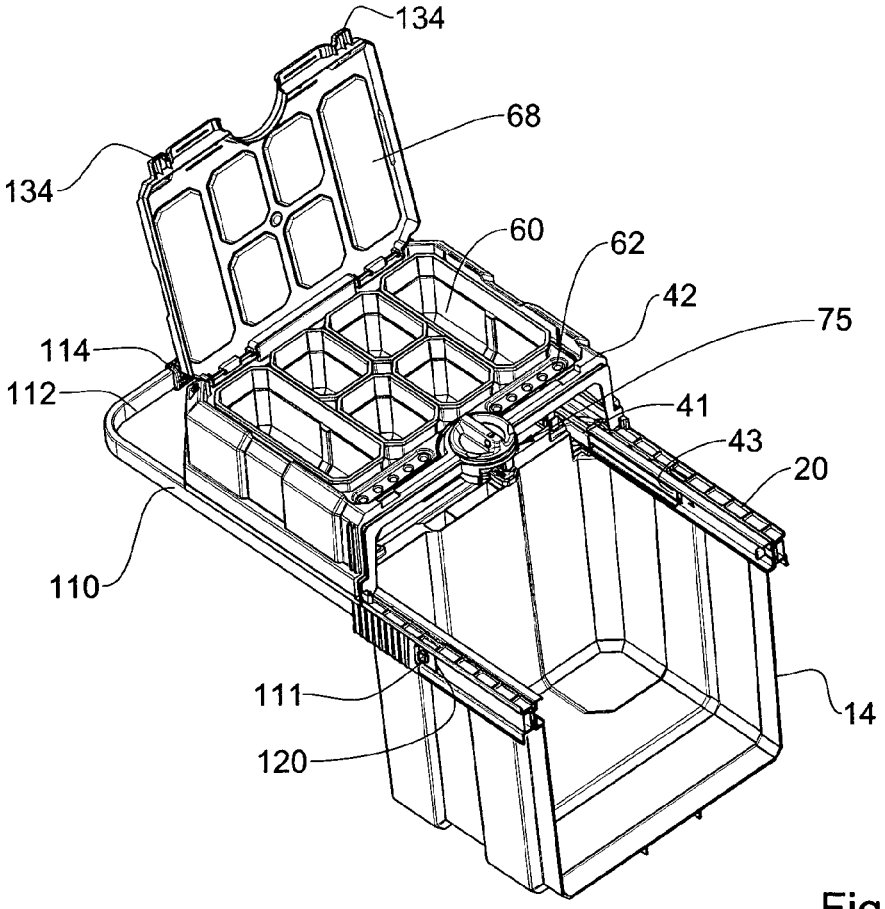
FIG. 5E is an isometric section along line IX-IX in FIG. 4A.
Figure 5F:
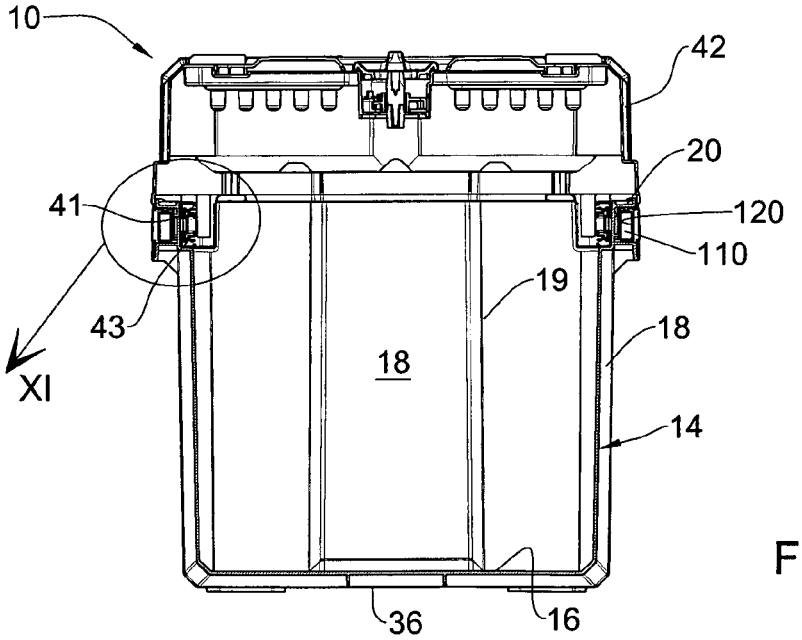
FIG. 5F is a front elevation sectioned along line XII-XII in FIG. 1A.
Figure 5G:
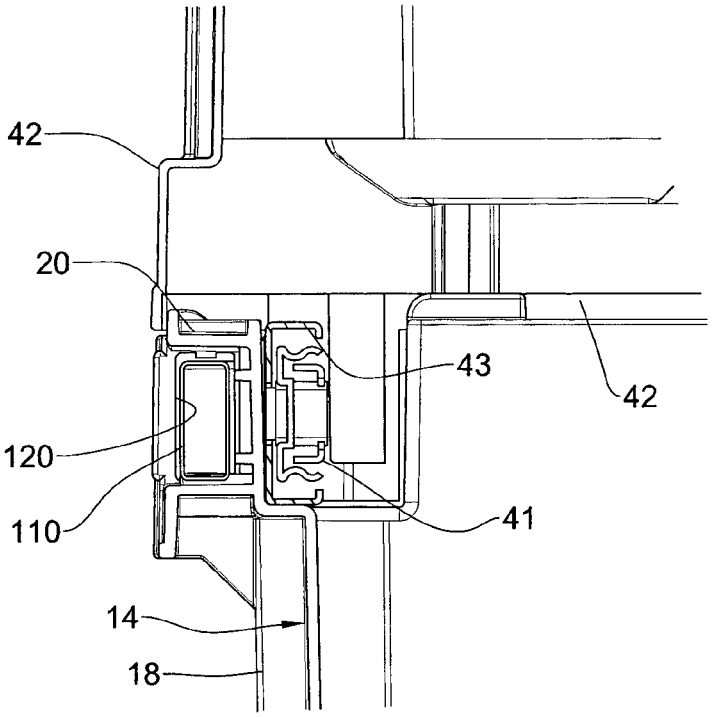
FIG. 5G is an enlargement of the portion marked XI-XI in FIG. 5F.
Figure 5H:
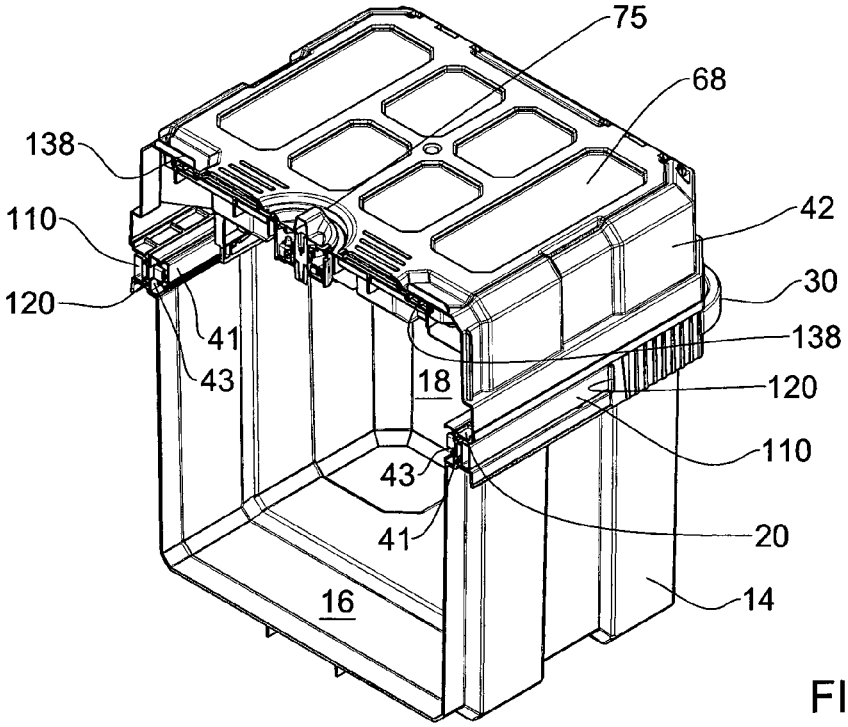
FIG. 5H is an isometric section along line XII-XII in FIG. 1A.
Figure 5I:
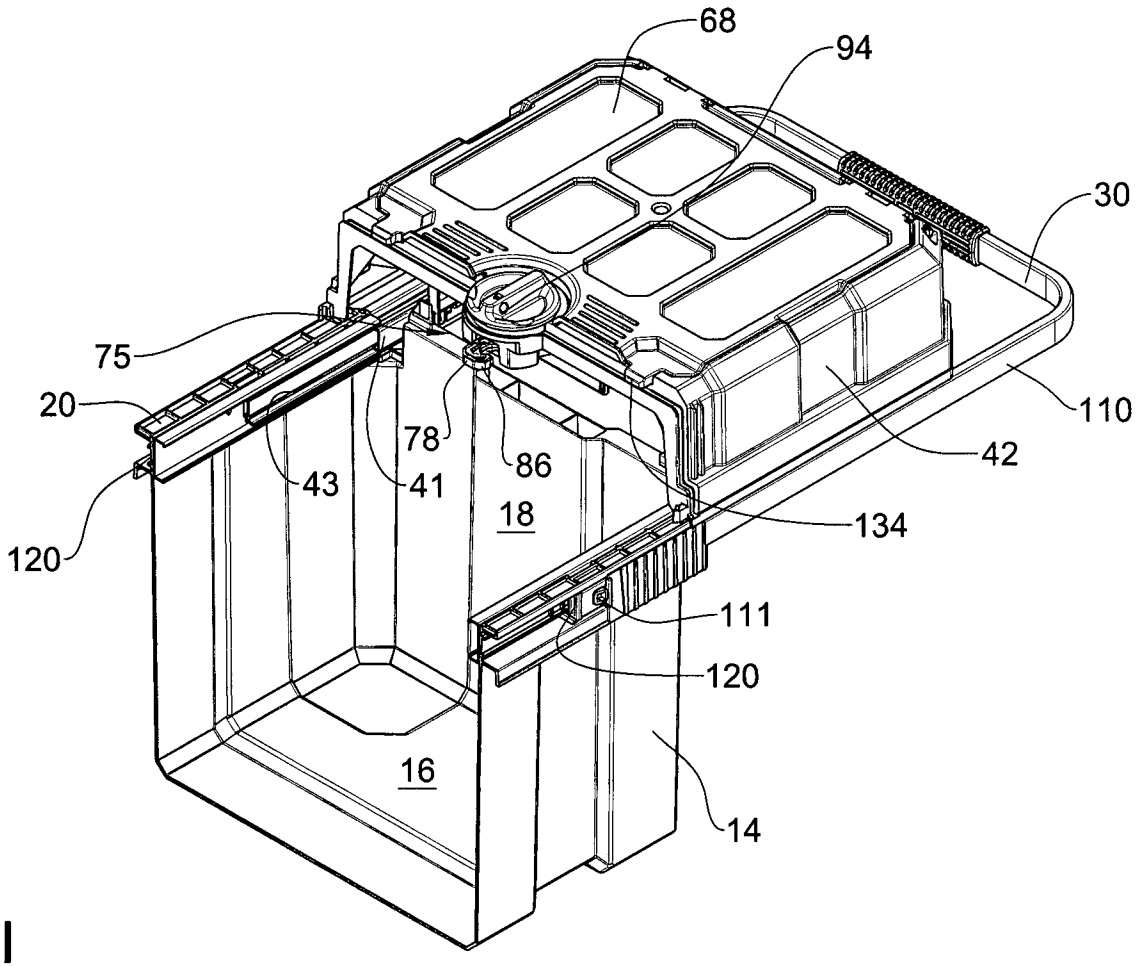
FIG. 5I is an isometric section along line XIII-XIII in FIG. 3.

Slideably mounted over the top edges 20 of the large compartment 14, there is a pair of compartmented covers 40 and 42, displaceable between a substantially closed position (FIGS. 1 and 2) and an open position (FIGS. 3 and 4). In the closed position, both the compartmented covers 40 and 42 fully extend over the opening of the large compartment 14 to thereby fully conceal it and prevent access thereto. In the open position the compartmented covers 40 and 42 are fully displaced into their respective open position, fully exposing the large compartment 14 and allowing access thereto. It is appreciated that each of the compartmented covers 40 and 42 may be independently slideably displaceable between the closed and open positions or, in accordance with an embodiment of the invention, the compartmented covers may be harmonically displaced into the respective closed/open positions by means of a retracting/extracting table and pulley system as known in the art.

As can be seen in some of the figures illustrating the tool box in the open position, and best in FIGS. 5E to 5I, it is appreciated that for sake of supporting the compartmented covers 40 and 42 at their fully open position and for smooth sliding displacement thereof, there is provided a slider assembly (e.g. a fully extension bearing drawer slide) fitted at each side of the compartmented covers, with one rail segment 41 of the slide fixedly secured to the top edge of the large compartment 14 and an other rail segment 43 thereof fixedly secured to the bottom edge of the respective compartmented cover.

Further appreciated, the compartmented covers 40 and 42 are provided with a plurality of storage bins 60 (in compartmented cover 42) as well as a screw bit holder tray 62. The other compartmented cover 40 is compartmented by displaceable partitioned walls 64 fixedly displaceable to thereby give rise to modular sub-compartments in the compartmented drawer 40. Each of the compartmented drawers 40 and 42 is fitted with a pivotal lid 68 to secure the contents received there within.

Figure 6:
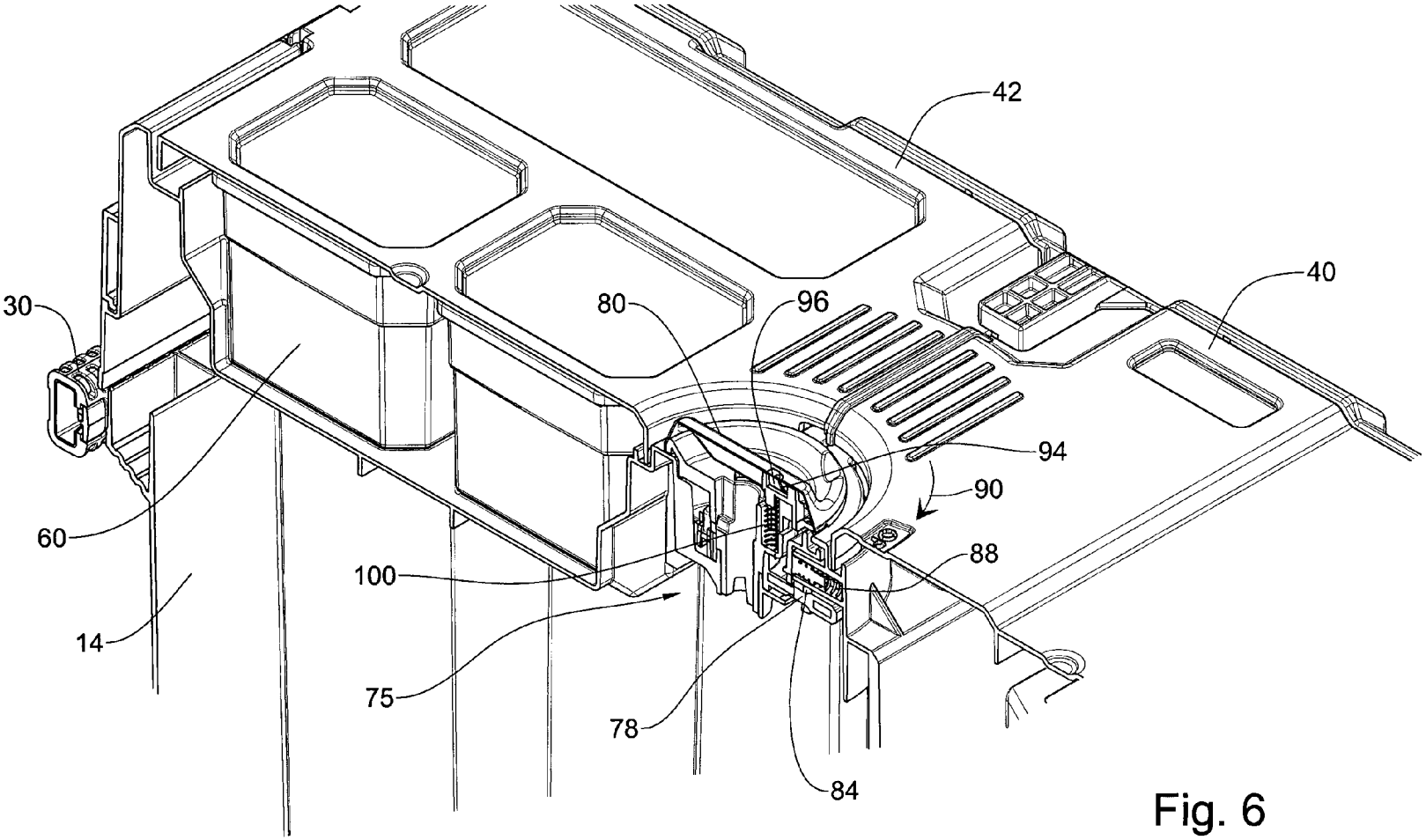
FIG. 6 is an enlargement of the portion marked X in FIG. 5A.
Figure 8:
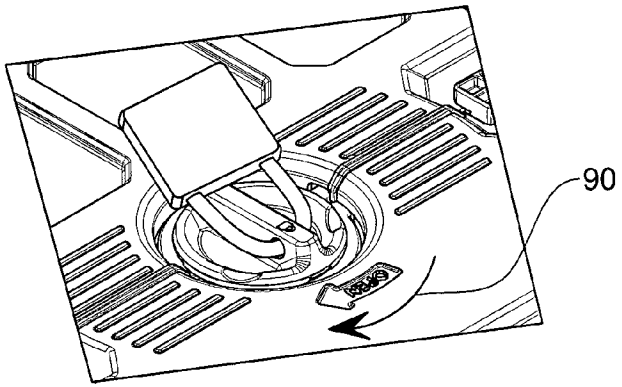
FIG. 8 illustrates the locking mechanism fitted with a security padlock.
Figure 7:
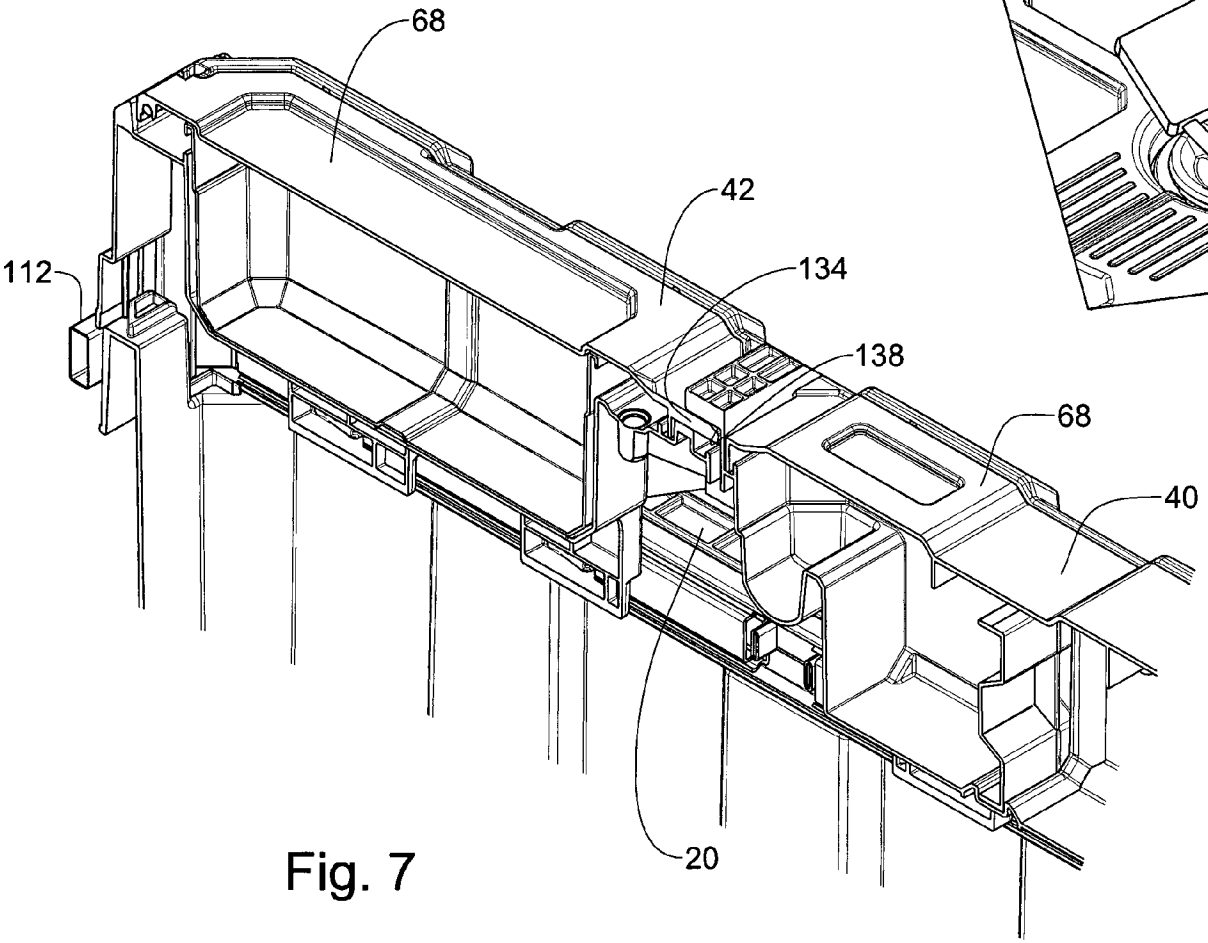
FIG. 7 is a longitudinal section along line XI-XI in FIG. 1A.

A locking arrangement is provided, generally designated 75. The locking arrangement comprises a locking mechanism fitted in the compartmented cover 42 and comprises a spring biased locking latch 78 manipulable by a rotatable switch-like knob 80 between a locking position (as illustrated in the figures) and an unlocked position, respectively. The other compartmented cover 40 is configured with a locking recess 84 (FIG. 6) fitted for locking arrestment of the locking latch 78. The locking recess 84 extends opposite the locking latch 78 and the locking latch is fitted with a chamfered edge 86 such that when the compartmented covers 40 and 42 are displaced towards one another into slam contact, the locking latch 78 spontaneously pivots against the biasing effect of spring 88 and then lockingly engages within the locking recess 84. Unlocking takes place by rotating the knob 80 in a clockwise direction (arrow 90) thereby disengaging the locking latch 78 from the locking recess 84.

In order to prevent unauthorized opening of the tool box, the knob 80 is fitted with an anti-tamper arrangement wherein upon insertion of a padlock through opening 94 in the knob 80, it results in displacement of arresting lever 96 into locking arrestment of the knob 80 preventing its rotation. Under normal circumstances, the lever 96 is spring biased by a coiled spring 100 preventing its unintended displacement.

Reverting now to the manipulating handle 30, it is noticed that it is composed of two side bars 110 and an interconnecting grip segment 112 extending therebetween and fitted with a cushioned grip 114. The arms 110 are slidingly displaced within parallel recesses 120 extending along the top edge 20 of the large compartment wherein the manipulating handle 30 is displaceable between a fully retracted position (FIGS. 1A to 1C) and a fully retracted position (e.g. FIGS. 1D, 2A and 2B) to facilitate pulling/pushing of the tool cart over the wheels 26. Each side bar 110 includes a stopper 111 which prevents it from being pulled completely out of the recesses 120. Typically, the manipulating handle 30 is made of rigid material such as metal and is configured to bear considerable loads of the tool box by a suitable moment of inertia. It is appreciated that at the retracted position the handle slightly, if at all, projects from the side walls of the tool box and however it does not interfere with the smooth sliding displacement of the respective compartmented cover 42.

Another locking arrangement is provided to prevent spontaneous and unauthorized opening of the lids 68 of the compartmented covers 40 and 42 respectively, this arrangement comprises one or more latches 134 configured on one or both of the lids 68, and configured for locking arrestment within corresponding recesses 138 configured respectively in the other compartmented cover.

Thus, once the compartmented covers 40 and 42 are in the closed position, the latches 134 are arrested within the respective grooves 138, preventing pivotal displacement of the lids 68. In the position illustrated in FIG. 1D, the tool box 10 is positioned in an upright position with the handle 30 extracted and wherein the tool box rests over surface 34 with wheels 26 and the rear support 39 configured of a top edge 39*a* of the large compartment and a bottom edge 39*b* of the compartmented cover 40.

This design provides sturdy support of the tool box 10 at the upright position, ready to be rolled away over the wheels 26.

Those skilled in the art to which this invention pertains will readily appreciate that numerous changes, variations, and modifications can be made without department from the scope of the invention, mutatis mutandis.

The invention claimed is:

1. A transportable tool box comprising:

a large compartment configured with upright extending side walls defining a top opening of the large compartment configured with a locomotive arrangement;

two compartmented covers configured with storage compartments, wherein the compartmented covers are slidingly displaceable over the top opening of the large compartment between a closed position wherein the compartmented covers coextend and cover the top opening, and an open position wherein the two compartmented covers are displaced away from one another and expose the large compartment to allow access thereto;

wherein the two compartmented covers each comprise a lid covering the storage compartments;

wherein the tool box is further fitted with a locking arrangement provided on each of said lids for arresting the lids at the closed position; and wherein the locking arrangement provided for arresting the lids at the closed position further provides locking of the compartmented covers when the compartmented covers are at the closed position.

2. The toolbox of claim 1 further comprising a rail system fitted at top front and top rear edges of the large compartment, wherein at a fully open position the compartmented covers are fully displaced from the top opening of the large compartment, to thereby facilitate full access thereto.

3. The toolbox of claim 1 wherein the compartmented covers are slidably secured to the large compartment by a pair of drawer-type slides, with ball bearings.

4. The toolbox of claim 1 wherein the compartmented covers are slidingly retained over the top opening of the large compartment, wherein at the closed position they mate about a center of the large compartment.

5. The toolbox of claim 1 wherein the storage compartments are further divided either fixedly or modularly or in a combination thereof.

6. The toolbox of claim 1 wherein the locomotive arrangement comprises at least one pair of wheels fitted near or at a bottom of the large compartment.

7. The toolbox of claim 1 wherein the locomotive arrangement comprises a manipulating handle articulated with the large compartment.

8. The toolbox of claim 1 wherein the locomotive arrangement comprises a manipulating handle articulated with the large compartment and wherein the manipulating handle is slidably displaceable between a stowed position in which it substantially blends with the large compartment, and a locomotive position in which it facilitates manipulating of the tool box in a cart like position.

9. The toolbox of claim 1 wherein the locomotive arrangement comprises a manipulating handle articulated with the large compartment and wherein a pair of wheels are provided at a bottom side edge of the large compartment and the manipulating handle is extractable from an opposite top side edge of the large compartment.

10. The toolbox of claim 1 wherein the locomotive arrangement comprises a manipulating handle articulated with the large compartment and wherein the manipulating handle comprises two side arms interconnected by a grip portion, wherein the side arms are slidably retained along respective top front and rear edges of the large compartment, and wherein the grip portion is substantially parallel to the respective top side edge such that at a stowed position it is flush with the large compartment.

11. The toolbox of claim 1 wherein the locking arrangement comprises a slam-type lock wherein locking engagement of the compartmented covers is achieved by displacing them towards one another until mating, resulting in spontaneous locking arresting of a locking latch provided on one of said lids that arrests with a respective latch provided on another of said lids.

12. The toolbox of claim 1 wherein the locking arrangement further comprises a locking mechanism configured to lock the two compartmented covers while the lids are pivotably displaced and in an unlocked position and configured for receiving a lock.

13. A transportable tool box comprising:

a large compartment configured with upright extending side walls defining a top opening of the large compartment configured with a locomotive arrangement;

two compartmented covers configured with storage compartments, wherein the compartmented covers are slidingly displaceable over the top opening of the large compartment between a closed position wherein the compartmented covers coextend and cover the top opening, and an open position wherein the two compartmented covers are displaced away from one another and expose the large compartment to allow access thereto;

wherein the two compartmented covers are each provided with a lid covering the storage compartments; and, wherein the tool box is further fitted with a locking arrangement provided on at least said lids for arresting at least the two compartmented covers at the closed position one with respect to the other.

14. A transportable tool box comprising:

a large compartment configured with upright extending side walls defining a top opening of the large compartment configured with a locomotive arrangement;

two compartmented covers configured with storage compartments, wherein the compartmented covers are slidingly displaceable over the top opening of the large compartment between a closed position wherein the compartmented covers coextend and cover the top opening, and an open position wherein the two compartmented covers are displaced away from one another and expose the large compartment to allow access thereto;

wherein the two compartmented covers each comprise a lid covering the storage compartments;

wherein the tool box is further fitted with a locking arrangement provided on at least the lids for arresting at least said two compartmented covers at the closed position and for preventing a pivotal displacement of the lids, wherein said lids cover the storage compartments so as to prevent access thereto; and wherein, a second locking arrangement is configured to lock the two compartmented covers while the lids are pivotably displaced and in an unlocked position.

* * * * *